United States Patent [19]

Bible

[11] Patent Number: 4,663,779

[45] Date of Patent: May 12, 1987

[54] PROTECTIVE COVERING OR BIB

[76] Inventor: Virginia L. Bible, 4515 Moorland Ave., Edina, Minn. 55424

[21] Appl. No.: 901,262

[22] Filed: Aug. 28, 1986

[51] Int. Cl.[4] ..... A41B 13/10

[52] U.S. Cl. ..... 2/49 R

[58] Field of Search ..... 2/49, 49 A, 48, 50, 2/51

[56] References Cited

U.S. PATENT DOCUMENTS

| | | | |
|---|---|---|---|
| 1,108,557 | 8/1914 | Dudley | 2/49 R |
| 1,284,252 | 11/1918 | Dalton | 2/49 R |
| 3,332,547 | 7/1967 | Rowe et al. | 2/49 R |

*Primary Examiner*—Doris L. Troutman

*Attorney, Agent, or Firm*—James V. Harmon

[57] ABSTRACT

A bib is described for infant or adult use comprising a backing sheet of clear glazed plastic having a breast panel, shoulder panels on either side of the neck opening and a clear pocket panel secured along an arcuate lower edge to the back panel. The rear terminal edge portions of the neck opening are spaced apart so that when they are drawn together around the neck of the user, the shoulder panels curve smoothly over the shoulders and the breast panel curves smoothly around the body of the user. The upper edge of the pocket is at least about 5% longer than the corresponding dimension of the back panel so that as the back panel curves around the body, the pocket stands in an open position. This is assisted by forming the front panel from a stiffer material than the back panel.

6 Claims, 5 Drawing Figures

PROTECTIVE COVERING OR BIB

FIELD OF THE INVENTION

The present invention relates to protective clothing articles such as bibs that protect the user when food is spilled during the eating of a meal or during activities such as oral hygiene, particularly necessary for the handicapped or aged.

BACKGROUND OF THE INVENTION

A primary object of the invention is the provision of an improved bib design that is suitable both for adult care such as care of the elderly, handicapped or disabled persons as well as infants which, of course, require a smaller size. When used with adults, the device will normally be referred to as a protective covering or clothing protector rather than a bib. The construction, however, will be the same.

In the past, protective coverings presented a bad appearance and, because they were associated previously only with infant care, were found objectionable by handicapped or aged adults. An important object of the invention, then, is to provide an improved protective covering which presents a greatly improved appearance and allows the clothing of the person to be seen beneath it. Prior bibs or protective coverings were also difficult to clean. Especially if a pocket was provided for catching crumbs, it was difficult or almost impossible to clean out the pocket without laundering the entire article.

A further problem is that the bibs previously available do not easily follow the contours of the body and the pocket, when present, would not, when the bib was contoured to the natural curvature of the body, stand in an open condition. It is therefore an object of the invention to provide an improved bib or protective covering having a pocket which stands in an open position with a further provision for the bib to automatically conform to the natural contours of the body when secured around the neck by the user and for the curvature of the bib around the body to assist the pocket in standing in an open position so that its effectiveness in catching spilled food is maximized.

SUMMARY OF THE INVENTION

A protective covering or bib is provided which includes a back panel formed from clear glazed plastic sheet material that defines a bib body having a breast panel and a pair of spaced apart shoulder panels adapted to curve rearwardly and downwardly over the shoulders with an opening between them for the neck. The terminal portions of the neck opening are spaced apart. The back panel has sufficient stiffness and body to resist puckering when the terminal edges of the neck opening are brought together around the neck of the user so that, as the shoulder panels form an arc a predetermined radius over the shoulders, the breast panel is thereby drawn to an arc contoured so as to curve around the body of the user. A pocket panel is attached to the front of the back panel and includes an upper horizontal free edge and an arcuate lower edge joined to a corresponding similarly curved lower edge portion of the back panel. The upper horizontal edge of the pocket panel is at least about 5% longer than a corresponding dimension of the back panel. The upper curved edge of the pocket is curved in an arc when the device is in use with a height which is greater than the height of the arc of the back panel; thereby the pocket panel stands away from the back panel to define an upwardly opening wide mouth to help catch spilled food. The pocket panel has a greater stiffness than the back panel. This also helps it stand away from the back panel and the lower corresponding similarly curved connected lower edges of the back panel and the pocket panel are each an arc of even curvature substantially uniform throughout to facilitate the cleaning of the pocket with an arcuate motion of the hand from one side of the pocket to the other.

THE FIGURES

DESCRIPTION OF THE INVENTION

Figure 1:
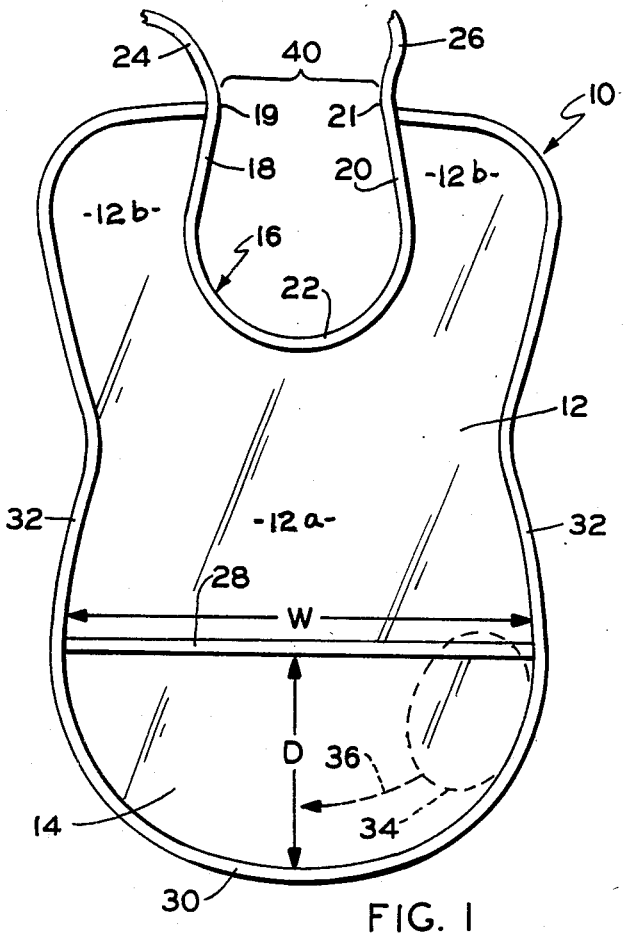
FIG. 1 is a plan view of the invention laid flat.
Figure 2:
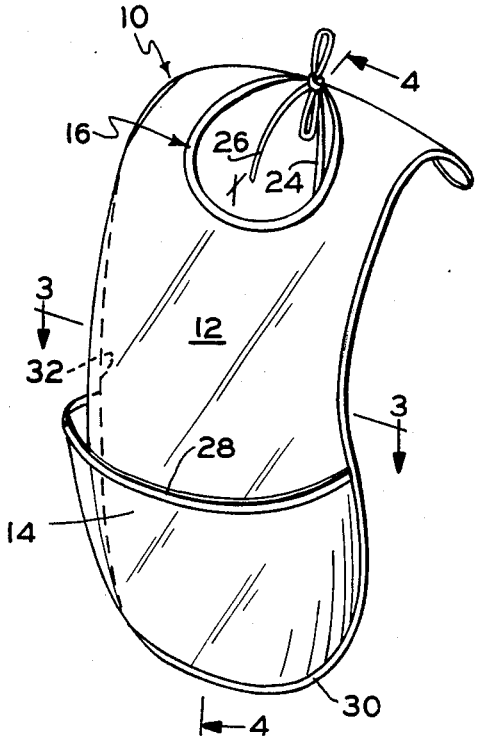
FIG. 2 is a perspective view of the invention as it appears during use on a slightly smaller scale.
Figure 5:
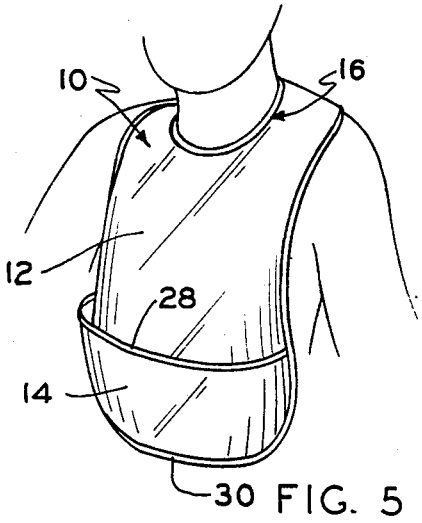
FIG. 5 is a perspective view on a smaller scale of the invention during use.

Refer now to the figures which illustrate a bib indicated generally by the numeral 10 which is suited both for infant use and for adult care and which, in the latter application, may be referred to simply as a protective covering. It includes a back panel 12 and a front panel or pocket panel 14 which is secured to the back panel along its lower and side edges. The back panel 12 covers the breast and stomach of the user and accordingly its central portion 12*a* may be thought of as a breast panel. Extending upwardly from the breast panel portion are a pair of shoulder panels 12*b* on either side of the neck opening 16 to which is secured an edging such as a bias tape 22 having side portions 18 and 20 that extend upwardly along the side edges of the neck opening 16 and include two end portions 24 and 26 which serve as ties for securing the neck opening 16 around the neck of the user. As clearly shown in FIG. 1, the terminal edges 19 and 21 of the neck opening 16 are positioned apart from one another by a space or gap 40 when the bib is laid flat as shown in FIG. 1. The back panel 12 is formed from a lightweight transparent glazed plastic sheet material which is supple yet has sufficient body and stiffness to resist puckering when the terminal end portions of 19 and 21 of the neck opening 16 are brought together around the neck of the user as in FIGS. 2 and 5. As this is done, the drawing of the points 19 and 21 together causes two things to happen because of the stiffness and body of the back panel 12. First, the shoulder panels 12*b* are drawn in an arc of radius A over the shoulders of the user. Secondly, the body panel is caused automatically to curve in an arc of a height B around the body of the user. This occurs naturally and is a consequence of the drawing together of the terminal portions 19 and 21 of the neck opening 16 and of the rearward and downward bending of the shoulder panels 12*b*.

The pocket panel 14 is formed from material similar to the back panel 12 but of greater stiffness. Thus, if the back panel 12 is formed from 12-gauge vinyl film, the front panel can be formed from 16-gauge vinyl film to provide greater stiffness. The front panel 14 includes a horizontally extending upper free edge 28 that may be covered with a suitable edging material such as ½"

folded bias tape. The bottom edge of the pocket panel 14 is curved and corresponds in shape to the similarly curved lower edge of the back panel 12. The corresponding similarly curved edges are aligned and bonded together for example by means of a sewn in bias tape defining a lower curved bottom edge where the front and back panels are joined together. As clearly seen in the figures, the connected curved edges of the panels define an arc which is of even curvature with a smooth edge substantially uniform throughout to facilitate cleaning, for example by placing the hand in the pocket and moving a cleaning rag 34 in an even curved path 36 from one side of the pocket to the other to facilitate thorough and rapid cleaning. The width of the pocket W is preferably about twice its depth D for infant use. The bias tape 30 extending around and connecting the pocket panel 14 to the back panel 12 extends upwardly at 32 along each side of the breast panel 12*a* and along the free edges of the shoulder panels terminating at points 19 and 21 adjacent the ties 24 and 26.

Figure 4:
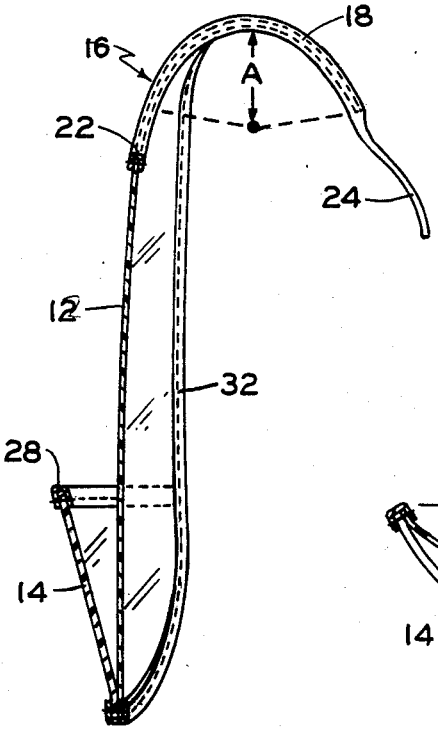
FIG. 4 is a vertical sectional view taken on line 4—4 of FIG. 2.
Figure 3:
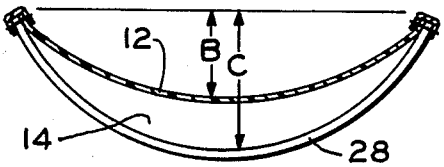
FIG. 3 is a transverse horizontal sectional view taken on line 3—3 of FIG. 2.

As shown in FIG. 4, the shoulder panels when secured around the neck of the user will form an arc of radius A over the shoulders. As seen in FIG. 3, the back panel 12 will at the same time be drawn into an arc having a height B around the body of the user to conform comfortably during use. The upper free edge 28 of the pocket panel is somewhat longer than the corresponding dimension of the back panel and accordingly, because of its greater stiffness and because of the greater dimension of its upper edge 28, the pocket panel will stand away from the back panel forming an arc having a height C that is greater than the height B of the back panel and the curvature of both panels 14 and 12 occurs automatically when the bib is placed on the body and the rear terminal portion 19 and 21 of the neck opening 16 are drawn together as the strings 24, 26 are tied around the neck. Thus, the pocket panel stands away from the back panel to define an upwardly opening wide mouth which is ready at all times to catch spilled food. Because the back and front panels are highly glazed and transparent, the bib allows the clothing of the user to be seen through it and accordingly it does not present a bad appearance. The pocket can be easily cleaned even if there is not enough time available for a complete cleaning or laundering.

The bib can be easily manufactured. The vinyl pieces are cut to size. The bias tape 22, 28, 30 is folded in half and stitched in place so as to encase the sides of the back and pocket panel as well as the horizontal upper edge 28 of the pocket panel. The bias tape is sewn around the outer edge of the bib beginning and ending at the terminal end points 19 and 21 and the tape is folded so as to enclose the edges of one or both sheets of plastic as the case may be and to simultaneously secure the pocket panel to the back panel 12. The neck opening 16 is then closed with the tape 22.

Because the pocket stands open during use, it catches material very efficiently. Moreover, the bib is waterproof, stain resistant and the pocket can easily be cleaned after every use. The clear material provides a pleasant appearance and maintains dignity for adult users. It also allows children's clothes to be easily seen which is particularly important when a child is dressed up for a party. The invention does not give the appearance of wearing a bib. The bias tape provides durability, keeps the edges from separating or tearing. The rounded lower edge allows easy cleaning and also allows liquid to pool in the center portion of the bottom preventing any spills over the outer corners of the pocket if the bib is tilted. Since the bib drapes naturally to conform to the shoulders and curves around the natural contour of the breast, it can be worn very comfortably and provides excellent protection. The bib is flexible allowing easy packing for storage and it is suitable both for infant and adult use by aged and handicapped persons or others.

A variety of variations are possible and the bib can be made of a variety of clear plastic film materials including polyolefins and polyesters. However, excellent results have been obtained with clear glazed vinyl film.

Many other variations of the invention within the scope of the appended claims will be apparent to those skilled in the art once the principles described herein are understood. For infant use, the top edge of the pocket is 10′ wide and the corresponding dimension of the back panel 12 is $9\frac{3}{8}''$. The term "bib" will for convenience be used herein to refer both to adult and infant applications.

What is claimed is:

1. A protective covering or bib to be used while eating to protect the clothing, comprising:

a back portion formed from clear glazed plastic sheet material defining a bib body having a breast panel with a pair of spaced apart shoulder panels projecting upwardly therefrom and defining a neck opening therebetween and the neck opening having spaced apart terminal edges with tie means connected to said terminal edges, the backing of the bib having sufficient stiffness and body to resist puckering when the terminal edges of the neck opening are brought together around the neck of the user so that the shoulder panels form an arc of a predetermined radius A and the breast panel is thereby drawn into an arc contoured so as to curve around the body of the user and having a height B.

A pocket-panel formed from glazed plastic sheet material having sufficient stiffness to stand away from the back panel, said pocket panel having an upper horizontal free edge and an arcuate lower edge joined to a similarly curved corresponding lower edge portion of the back panel, the upper horizontal edge of the pocket panel being at least about 5% longer than the corresponding dimension of the back panel, the upper curved edge of the pocket when the bib is in use being curved rearwardly into an arc around the body of the user with a height C greater than the height B of the arc of the body panel curved rearwardly about the body of the user whereby the pocket panel stands away from the back panel to define an upwardly opening wide mouth for catching spilled food and the lower corresponding edge of the pocket panel where adjoined to a similarly curved edge of the back panel is an arc of even curvature with a smooth edge substantially uniform throughout to facilitate cleaning of the pocket.

2. The bib of claim 1 wherein the width of the pocket W is about twice the depth of the pocket D.

3. The article of claim 1 wherein the back panel is a clear glazed vinyl film and the pocket panel is also a clear glazed vinyl film, the thickness of the pocket panel being greater than the thickness of the back panel whereby the vinyl pocket panel is stiffer than the back panel to hold the mouth of the pocket open.

4. The article of claim 3 wherein the pocket panel is about 16 gauge vinyl film and the back panel is about 12 gauge vinyl film.

5. The article of claim 4 wherein a bias tape is sewn around the peripheral edge of the back panel and corresponding aligned superimposed edges of the pocket and back panel.

6. The article of claim 1 wherein fastener means is provided at the terminal end portions of the neck opening and said fastening means comprises tie strings extending therefrom.

* * * * *